United States Patent [19]

Granata

[11] Patent Number: 4,546,560

[45] Date of Patent: Oct. 15, 1985

[54] SEAM PRESSER

[76] Inventor: Helen E. Granata, 14730 S. Kilpatrick - 2E, Midlothian, Ill. 60445

[21] Appl. No.: 663,332

[22] Filed: Oct. 22, 1984

[51] Int. Cl.[4] ..... D06F 75/24; D06F 75/30

[52] U.S. Cl. ..... 38/1 B; 38/79; 38/89; 219/229; 228/53

[58] Field of Search ..... 219/239, 238, 228, 243, 219/242, 229; 38/1 B, 79, 81, 88, 13, 89; 228/51, 53, 55

[56] References Cited

U.S. PATENT DOCUMENTS

| | | | |
|---|---|---|---|
| 1,702,271 | 2/1929 | Rosenbaum et al. . | |
| 2,086,102 | 7/1937 | Stradling | 219/242 X |
| 2,417,943 | 3/1947 | Muller | 219/228 X |
| 2,452,259 | 10/1948 | Pabis | 219/238 |
| 3,742,882 | 7/1973 | Wren . | |
| 3,755,649 | 8/1973 | Osnow . | |
| 3,902,043 | 8/1975 | Rogan | 219/238 X |
| 3,976,020 | 8/1976 | Aulich et al. . | |
| 4,016,822 | 4/1977 | Pugliese . | |
| 4,023,724 | 5/1977 | Wakita et al. | 228/53 X |
| 4,238,665 | 12/1980 | Tremarco | 219/228 X |
| 4,435,635 | 3/1984 | Parker | 219/229 |
| 4,441,014 | 4/1984 | Hong | 219/238 X |

FOREIGN PATENT DOCUMENTS

| | | | |
|---|---|---|---|
| 134220 | 1/1952 | Sweden | 219/228 |

*Primary Examiner*—Werner H. Schroeder
*Assistant Examiner*—Andrew M. Falik
*Attorney, Agent, or Firm*—Lloyd L. Zickert

[57] ABSTRACT

A seam presser including an elongate handle housing circuitry for switching electrical power to a heating element. The heating element conducts heat to a small sole plate which is connected to the handle end by a support means. The sole plate is no wider than the seam to be pressed and is mountable to the support means so that the plane of the sole plate undersurface is angled with respect to the handle, and mountable to the support means at a desired rotational angle with respect to the handle.

3 Claims, 6 Drawing Figures

SEAM PRESSER

This invention relates in general to garment and fabric ironing apparatus, and more particularly to a hand held device for pressing the overlapped edge portion of the stitched seam flat against the material.

Heretofore, it has been well known to provide seam pressers of various types operating in conjunction with sewing machines. Various types of seam pressers are disclosed in U.S. Pat. Nos. 1,683,412; 1,702,271; 3,742,882; 3,976,020 and 4,016,822. Further, it has been well known to use a conventional household hand iron to accomplish the pressing of garment seams.

The heretofore known systems when used in conjunction with sewing machines tend to be undependable due to the complexity of the apparatus and the need for moving parts to pull the material through the pressing apparatus. A further shortcoming of these seam pressers is that because they are an integral part of the sewing machine they are not portable and thus their use at remote locations is impractical. Because the majority of these seam pressers are tailored for operating on straight seams, such systems present problems when the operators attempt to press irregular shaped seams, such as a seam that changes directions 180 degrees.

Conventional household laundry irons, while portable, are designed to maintain a large surface area of the iron at a desired elevated temperature and thus such a structure is wasteful of energy when pressing a narrow width seam. The household irons suffer another shortcoming insofar as the pressure applied by the hand iron to the seam is distributed over the seam, as well as the adjacent material, and thus the quality of the pressed seam is not as good as it could be. Further, an edge of the seam allowance may be pressed into the single layer material leaving an undesirable image on the front surface of the material.

The present invention overcomes the difficulties heretofore encountered in that it is a compact hand held device which is portable and thus can be easily moved form work station to work station, and the sole plate is dimensioned to cover less than the width of the overlapped part of the seam or the seam allowance. In this manner, only the seam allowance is pressed, and thus the pressure applied to the device is concentrated only on the seam to crease the material where the fabric pieces are stitched. In addition, any undesirable image caused by an oversized iron is eliminated and importantly, energy is conserved as a smaller heating element can be used in conjunction with the smaller sole plate.

More particularly, the present invention is generally elongate in nature and includes a cylindrical handle for holding the device, and a support structure for supporting the sole plate axially outwardly from the handle and at the butt end of the handle. The sole plate is removably fixed to the handle such that the plane formed by the underside of the sole plate is angled with respect to the elongate handle at an angle of about 30 degrees. Even more particularly, the handle of the present invention houses a finger-operated switch and circuitry for controlling the amount of heat developed by the device. The sole plate support structure is butted against a number of raised areas on the front end of the handle and secured thereto by screws. In one embodiment of the invention an electrical heating element is disposed within the sole plate support structure whereupon heat is transferred to the sole plate. A heat shield surrounds the sole plate structure and prevents contact of the fabric with the hot support structure and fabric damage. In another embodiment the heating element is located directly within the sole plate. In both embodiments the sole plate includes a hole disposed and angled into its top surface for receiving the support structure and orienting the sole plate in an angled relationship with respect to the handle.

It is therefore an object of the present invention to provide a new and improved portable hand held seam presser.

Another object of the present invention is to provide a seam presser with an elongate body part by which the device is held, and a sole plate attached thereto and angled with respect to the handle.

A further object of the present invention is to provide a lightweight compact seam presser which can be hand held much like a flashlight, or by the fingers like a pencil.

Still another object of the present invention is to provide a seam presser with a sole plate having a width less than the width of the seam allowance to be pressed.

Other objects, features and advantages of the invention will be apparent from the following detailed disclosure, taken in conjunction with the accompanying sheet of drawings, wherein like reference numerals refer to like parts.

Figures 1, 2, 3, 4, 5, 6:
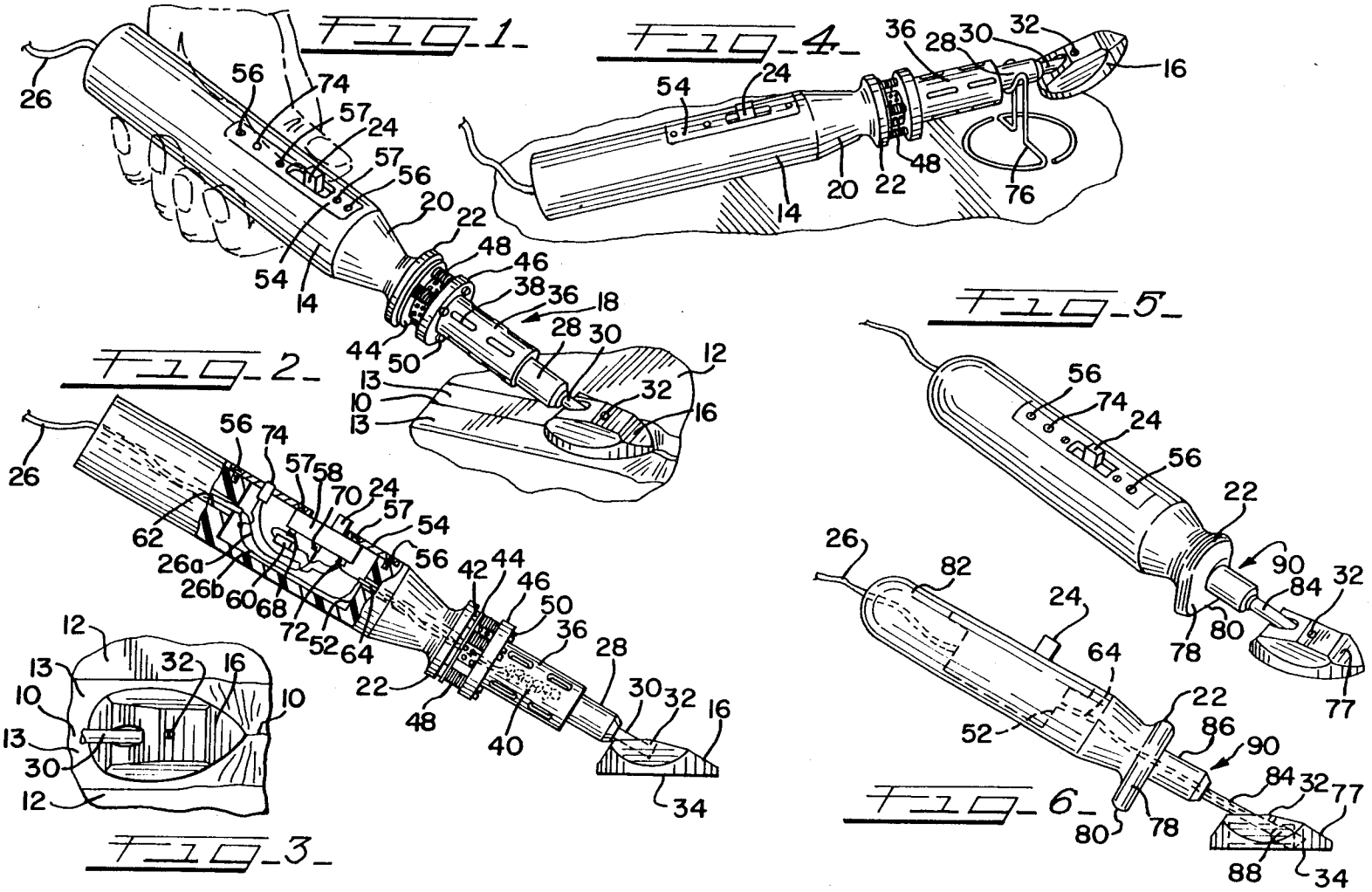
FIG. 1 is an isometric view of the seam presser according to the present invention.
FIG. 2 is a side plan view of the seam presser of the present invention partially sectioned to illustrate the circuitry housed within the handle.
FIG. 3 is top plan view of the sole plate.
FIG. 4 is an isometric view of the seam presser resting in a cradle support.
FIGS. 5 and 6 illustrate respectively isometric and side plan views of another embodiment according to the present invention with the heating element located within the sole plate.

Referring now to the drawings and particularly to FIG. 1, an elongate hand held seam presser of the invention is illustrated as it is applied to press a seam 10 defined between two fabric pieces 12 stitched together. When pressed, the seam allowance flaps 13 on each side of the seam 10 are flattened against the workpiece 12 forming creases at the seam. According to the first embodiment of the invention the seam presser generally includes an elongate handle 14 and a sole plate 16 connected to the handle end by a support structure 18 housing a heating element 40 (FIG. 2). A heat shield 36 protects fabric from contacting a hot heat element housing 28. The elongate design of the seam presser can thus be easily gripped by one's hand, as shown in FIG. 1 or otherwise, to apply maximum pressure on the fabric seam 10. The elongate handle 14 also includes a tapered front end 20 terminating in a flange 22 flared outwardly to provide a finger stop, and also an end against which the support structure 18 can be fastened in an abutting relationship. With this construction, the handle taper 20 and the flange 22 allow the user to grip the device much like a pencil and apply pressure to delicate seams or irregularly curved seams.

FIG. 1 further illustrates a switch 24 for controlling electrical power supplied via a power cord 26 to the heating element 40. Heat is thermally conducted from the heating element housing 28 to the sole plate 16 by a solid metal stud 30 threaded into the heating element housing 28 and fixed at the other end thereof into the sole plate 16 by a set screw 32. The sole plate 16 can thus be fixed to the support structure 18 at any angular position with respect to the switch 24 such that the sole plate 16 is always situated with its flat undersurface 34 (FIG. 2) disposed downwardly for any desired angular position of the switch 24. This is especially advantageous as right-handed and left-handed users may prefer any different angular positions of the handle 14, and thus the switch 24, with respect to the same orientation of the sole plate 16.

According to FIG. 1 the invention further provides a ventilated heat shield 36 surrounding the heating element housing 28. The heat shield 36 includes vent holes 38 spaced around the shield for dissipating excess heat which is not conducted to the sole plate 16. The heat shield 36 may cover the heating element 28 entirely to further prevent the inadverent contact of fabric with the hot housing 28 or stud 30 and damage the work piece. It should be appreciated that in the embodiment of FIG. 2 the heating element 40 is the source of heat and thus it maintains the housing 28 at a higher operating temperature than the sole plate 16. The source of heat for the sole plate 16 is a conventional coiled resistance wire 40, such as Nichrome, embedded within the heating element housing 28 and in thermal contact therewith. Those skilled in the art can easily select a particular heating element wattage rating to produce a sole plate temperature range for pressing seams of various fabric types. In the preferred embodiment the sole plate is constructed of brass with the general shape as that shown in the figures, including a respective width, length and height of one inch, 1.75 inch and 0.50 inch. The normal dimension for a seam is five eighths inch for each seam allowance flap totaling one and one quarter inch from edge to edge when pressed: Thus, the one inch width of the sole plate is less than the total seam allowance. Anodized or chrome plated hard aluminum may also be used as a sole plate material.

In addition to providing a protective cover around the heating element housing 28, the heat shield 36 also forms a part of the structure which mounts the support structure 18 to the end of the handle 14. The heat shield 36 is constructed of Bakelite material, or any other suitable heat insulating material. The manner by which the support structure 18 is moiunted to the handle is best understood by reference to FIG. 2.

The heating element housing 28 is constructed with a flange 44 at its end. The heat shield 36 also includes a flange 46 integral thereto and spaced from the heating element flange 44 by a plurality of spacers 48. Each spacer 48 has a bore therethrough. The heating element housing flange 44 and the heat shield flange 46 have aligned holes drilled therein and spaced around the respective flanges, the number of holes being equal to the number of spacers 48 employed. The raised areas 42 on the handle flange 22 are formed together with the nylon handle and are spaced in a manner exactly like the holes in flanges 44 and 46. The raised areas 42 further include bored holes wherein self-tapping screws 50 are passed through the heat shield flange 46, the spacers 48, the heating element housing flange 44 and finally threaded into the raised areas 42 and the handle flange 22. With this arrangement, there exists a ventilating area between the handle flange 22 and the heat conducting heating element housing flange 44. In addition, the raised areas 42 and the spacers 48 maintain the heating element housing flange 44 separated from the respective handle 14 and heat shield 36 so that the latter parts do not become deteriorated because of heat. Furthermore, this arrangement advantageously maintains the heating element housing 28 centered within the heat shield 36 and out of contact therewith, except through the spacers 48.

Another feature of the invention is the handle 14 of the seam presser which includes a circuit chamber 52 (FIG. 2) accessible by way of a nylon cover plate 54 which is flush with the handle surface and fastened to the handle 14 by a pair of screws 56. Easy access to control circuitry for repair is had by the removal of the cover plate 54. The control circuitry by which the temperature of the heat element 40 is controlled is comprised of a three position switch 58 and a diode 60.

A bore 62 is located centrally and axially through the handle 14 and provides a channel through which the AC power cord 26 enters the chamber 52 and out of which conductors 64 carrying controlled power are routed to the heat element 40. Switch 58 is of the type having a slide lever 24 movable to three positions, namely a low, off and high power setting. FIG. 2 illustrates the seam presser with the switch slide lever 24 in the high power setting. In the low power position the switch terminals 68 and 70 are internally shorted, and in the high power position terminals 70 and 72 are internally shorted. In the off position (middle slide position) terminal 70 is isolated from either terminals 68 or 72 and no AC power is delivered to the heat element 40. The anode of diode 60 is connected to switch terminal 68, and the diode cathode terminal is connected to switch terminal 72. Power cord conductor **26*a* is connected as the hot AC conductor, while conductor 26*b* is connected as the neutral AC conductor. The neutral conductor 26*b* is connected from the power cord 26 directly to the heat element 40, while the hot conductor 26*a* is switched by switch 58, in the high position, directly to the heat element 40 via internally shorted switch terminals 70 and 72. In the low power position, switch 58 shorts terminals 68 and 70 whereby diode 60 is inserted in series between hot conductor 26*a* and the heat element 40. With the diode 60 switched into conductor 26*a* AC input power is rectified and thus the full sixty cycle power is not delivered to the heat element 40. To that end, the reduced power delivered to the heating element 28 represents the low power setting of the seam presser. As noted above, when the switch lever 24 is in the off position all power is prevented from reaching the heat element 40**.

Access cover 54 includes a slot in which the switch lever 24 slides to the three positions, as well as holes through which screws 57 may be passed to secure the switch 58 to the cover 54. In addition, access cover 54 includes a hole in which an indicator lamp 74 is press fit. Indicator lamp 74 may be a neon-type lamp with an internal or externally mounted resistor (not shown). As shown in FIG. 2, indicator lamp 74 is connected across the conductors connected to the heat element 40 and thus the lamp 74 illuminates when either high or low power is applied to the heat element 40.

FIG. 3 is illustrative of the shape of the sole plate 16 which is effective in pressing ruffled seams. The sole plate 16 is of a width no wider than the seam to be pressed and preferably of a width slightly less than the seam allowance width. As noted above, this prevents an image from being visible on the outside of the garment material. Sole plates of various widths may be employed to accommodate seams of various widths. In the embodiment described thus far, the replacement of sole plate 16 may be accomplished simply by loosening the set screw 32 and sliding the sole plate off of the connecting stud 30. A new sole plate is installed by reversing these operations.

FIG. 2 shows that the stud 30 enters the sole plate 16 at an angle which assures that the undersurface 34 of the sole plate 16 is maintained horizontal, such as over the work surface of a table, while the handle 14 is angled upwardly in a position which can be comfortably held by the user. It has been found that when an angle between a horizontal surface and the elongate seam presser is about 30 degrees a good compromise is had between the downward pressure by the sole plate on the seam and the forward movement of the device along the seam.

In FIG. 4 there is shown the seam presser according to the invention resting on a cradle support 76. In an alternative embodiment of the invention, as shown in FIGS. 5 and 6, the rest support 78 of the seam presser is formed as part of the handle flange 22. This feature of the invention eliminates entirely the need for the separate cradle support 76. The integral rest support 78 is formed with a flat bottom side 80 to provide stability and prevent the device from rolling when resting on a flat work surface. As shown in FIG. 6, the rest support 78 extends somewhat beyond the width of the device to assure that when the device is laid down on a surface the hot sole plate 77 is fulcrumed away from the work surface by the weight of the heavier handle 82.

The control circuitry for controlling the temperature of the sole plate 77 is in all respects the same as the circuitry discussed in connection with the embodiment of FIG. 2. The handle 82 of the alternative embodiment, however, is shorter and slimmer than that of the FIG. 2 embodiment so that the device can be held more easily like a pencil.

The sole plate support structure 90 comprises a tubular stem 84 joined to a barrel member 86, both elements of which provide a medium through which the sole plate 77 is connected to the handle 82, and through which electrical conductors 64 are routed to a heating element 88 in the sole plate 77. The tubular stem 84 is suitably fastened to the barrel member 86, such as by threads or press fitting, and the barrel member 86 is similarly attached to the handle 82. In the preferred form the barrel member 86 is constructed of a heat resistant plastic material, and the tubular stem 84 is steel. Of course, other suitable materials may be used.

In keeping with the invention, the sole plate 77 includes a cartridge-type heating element 88 held firmly therein. The heating element 88 may be of about the same diameter as the tubular stem 84 and thus only a single bore need be made at an angle within the sole plate 77. As with the solid stud 30 of the first embodiment discussed above, the tubular stem 84 is fixed within the sole plate 77 by a set screw 32. Because heat is transmitted directly from the cartridge heater 88 to the sole plate 77, and not by way of the support structure 90, the cartridge heater 88 may be electrically and physically smaller. In addition, because of the common bore within the sole plate 77 the cartridge heater 88 is captured therein by the tubular stem 84.

From the foregoing, it can be appreciated that the present invention provides a seam presser which is portable, compact, lightweight, energy efficient and highly advantageous when used for pressing garment seams, or the like.

It will be understood that modifications and variations may be effected without departing from the scope of the novel concepts of the present invention, but it is understood that this application is to be limited only by the scope of the appended claims.

The invention is hereby claimed as follows:

1. A seam presser for pressing a seam having a seam allowance of a given width defined by two pieces of fabric stitched together, comprising, an elongate handle with a front and rear end and including a bore therethrough, said handle including a circular flange at the front end having an end face with a plurality of circumferentially arranged raised portions, an electrical heating element fixed to the flange at the front end of said handle and including electrical conductors routed through said bore, a vented heat shield surrounding said heating element and fixed to the front end of said handle, said heating element having a flange at the end fixed to the handle abutting against said raised portions, said heat shield having a flange at the end adjacent the handle, spacers disposed between the heat shield flange and the heating element flange, and means fastening said heat shield and heating element to said handle which extend through said heat shield flange, the spacers, and the heating element flange, whereby heat from the heating element is dissipated between the heat shield and the handle and said heat shield protects against contact between the heating element and fabric, a sole plate having a pointed leading end with a flat undersurface for presing seams and connected to said heating element for thermally conducting heat away from said heating element, and sole plate having a width less than the given width of the seam allowance so that the sole plate edges stay within the seam allowance during pressing and being connected to said heating element so that the plane of said undersurface is angled with respect to the axial axis of said handle.

2. The seam presser of claim 1 wherein said sole plate is removably connected to said heating element.

3. The seam presser of claim 1 wherein the plane of the undersurface of said sole plate is angled about 30° with respect to the axial axis of said handle.

* * * * *